US006144373A

United States Patent [19]

Nakazawa et al.

[11] Patent Number: 6,144,373

[45] Date of Patent: Nov. 7, 2000

[54] PICTURE DISPLAY DEVICE AND METHOD OF DRIVING PICTURE DISPLAY DEVICE

[75] Inventors: Akira Nakazawa; Kazuyoshi Kawaguchi; Yoshinori Hirai, all of Yokohama, Japan

[73] Assignees: Asahi Glass Company Ltd.; Optrex Corporation, both of Tokyo, Japan

[21] Appl. No.: 08/980,342

[22] Filed: Nov. 28, 1997

[30] Foreign Application Priority Data

Nov. 28, 1996 [JP] Japan ..... 8-318193
Dec. 5, 1996 [JP] Japan ..... 8-325712

[51] Int. Cl.[7] ..... G09G 5/00

[52] U.S. Cl. ..... 345/204; 345/58; 345/89; 345/96; 345/211

[58] Field of Search ..... 345/204, 210, 345/211, 212, 58, 94, 95, 100, 89, 147–149, 208, 96–98

[56] References Cited

U.S. PATENT DOCUMENTS 5,262,881 11/1993 Kuwata et al. ..... 345/94
5,682,177 10/1997 Kuwata et al. ..... 345/100
5,774,101 6/1998 Hirai et al. ..... 345/89
5,798,741 8/1998 Kajihara ..... 345/94

*Primary Examiner*—Richard A. Hjerpe
*Assistant Examiner*—Francis Nguyen
*Attorney, Agent, or Firm*—Oblon, Spivak, McClelland, Maier & Neustadt, P.C.

[57] ABSTRACT

A method of driving a picture display device having an N number (N is an integer of not less than 2) of scanning electrodes and a plurality of data electrodes and being capable of optically responding to an effective value of a voltage applied to a pixel, which includes dividing the scanning electrodes into an M number of subgroups each having L rows, and applying voltages based on signals formed by expanding time-sequentially column vectors of an orthogonal matrix (A) having L rows to the scanning electrodes in each of the subgroups in order to select each of the subgroups together, changing, every time when a selection pulse is applied, the subgroups to which the selection pulse is applied, wherein L is 8 or less and N is 200 or more; the polarities of scanning voltages and data voltages are inverted with a periodicity of S times (S is a natural number) of a selection pulse width, and S is so determined that when an integer portion in the quotient of M/S is an even number, a remainder b satisfies S/b<12, and when an integer portion in the quotient of M/S is an odd number, a remainder b satisfies S/(S−b)<12.

10 Claims, 5 Drawing Sheets

EXAMPLE OF 4X4 HADAMARD'S MATRIX
| | | | | |
|---|---|---|---|---|
| L=1 | 1 | 1 | 1 | 1 |
| L=2 | 1 | -1 | 1 | -1 |
| L=3 | 1 | 1 | -1 | -1 |
| L=4 | 1 | -1 | -1 | 1 |
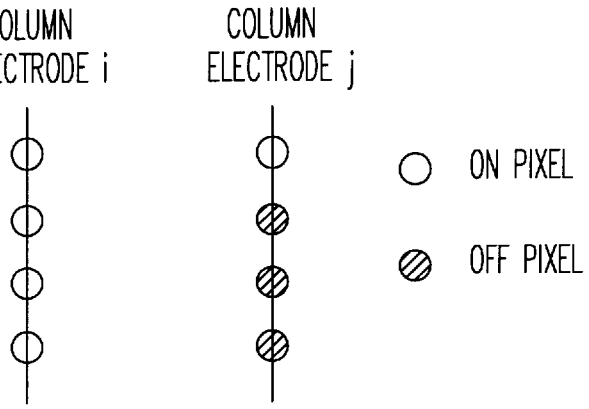
*FIG. 3A*
*PRIOR ART*
COLUMN ELECTRODE i
(d) (-1 -1 -1 -1)
(v) (-4 0 0 0)
COLUM ELECTRODE j
(d) ( -1 1 1 1)
(v) ( 2 -2 -2 -2)
*FIG. 3B*
*PRIOR ART*
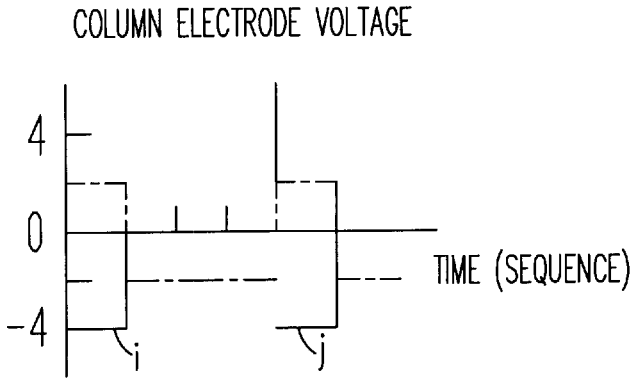
*FIG. 3C*
*PRIOR ART*

$$(A)=\begin{pmatrix} 1 & 1 & 1 & 1 \\ 1 & -1 & 1 & -1 \\ 1 & 1 & -1 & -1 \\ 1 & -1 & -1 & 1 \end{pmatrix}$$

FIG. 4A

PRIOR ART $$(A)=\begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

FIG. 4B

PRIOR ART $$(A)=\begin{pmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

*FIG. 4C*
*PRIOR ART*

$$\begin{pmatrix} -1 & 1 & 1 & 1 \\ 1 & -1 & 1 & 1 \\ 1 & 1 & -1 & 1 \\ 1 & 1 & 1 & -1 \end{pmatrix}$$

*FIG. 5*

PICTURE DISPLAY DEVICE AND METHOD OF DRIVING PICTURE DISPLAY DEVICE

BACKGROUND OF THE INVENTION

1. Field of the Invention

The present invention relates to a method of driving a liquid crystal display device which is suitable for liquid crystal of quick response. In particular, the present invention relates to a passive matrix type liquid crystal display device performing a multiplex driving by a multiple line simultaneous selection method (see JP-A-6-27907, U.S. Pat. No. 5,262,881).

2. Prior Art

Hereinafter, in this specification, a scanning electrode is referred to as a row electrode or simply as a line, and a data electrode is referred to as a column electrode.

With the progress of the advanced information age, a need for information media of display has been more increasing. A liquid crystal display has advantages such as thin structure, light weight, low power consumption etc. and has good coordination with semiconductor technology, and accordingly it is expected to become more wide spread. With the spread of liquid crystal displays, there are requirements of a large-sized picture surface and high precision, and a search for a method of performing a large capacity display is beginning. Among them, a STN (super-twisted nematic) system has advantages that its manufacturing steps are simple and manufacturing can be performed at a low cost in comparison with a TFT (thin-film transistor) system.

A line-sequential multiplex driving method has conventionally been carried out in the STN system in order to achieve a large capacitance display. In this method, respective row electrodes are successively selected one by one and column electrodes are driven in correspondence with a pattern to be displayed, and the display of one screen is finished after all the row electrodes have been selected.

However, it has been known in the line-sequential driving method that it causes a problem called frame response with an increase in the display capacity. In the line-sequential driving method, a relatively large voltage is applied to a pixel in a selection time and a relatively small voltage is applied thereto in a non-selection time. The ratio of the voltages is generally increased with an increase in the number of lines (i.e., with an increase in high duty drive). Accordingly, it results that liquid crystal which has responded to an effective value of a voltage when the voltage ratio is small, now responds to an applied waveform. Thus, the frame response is a phenomenon in which the transmittance of the liquid crystal at an OFF time is increased since the amplitude of a selection pulse is large, the transmittance thereof at an ON time is decreased since the period of selection pulses is long and as a result, a reduction of the contrast ratio is caused.

Although there has been known a method of increasing the frame frequency by which the period of the selection pulse is shortened, to suppress the occurrence of the frame response, it has a serious drawback. Namely, when the frame frequency is increased, the frequency spectrum of the applied waveform becomes higher, and accordingly, non-uniformity of display is caused and power consumption is increased. Therefore, there exists an upper limit in the frame frequency in order to prevent the selection pulse width becoming too narrow.

A new driving method has recently been proposed to solve the problem without making the frequency spectrum higher, namely, a multiple line simultaneous selection method wherein a plurality of row electrodes (selection electrodes) are selected simultaneously. According to this method, a plurality of row electrodes are simultaneously selected and a display pattern in a column direction can independently be controlled. According to this method, the frame period can be shortened while maintaining the selection width constant. Namely, a high contrast ratio display while controlling the frame response can be achieved.

In the multiple line simultaneous selection method, when a plurality of row electrodes are simultaneously selected, a predetermined voltage pulse series is applied to the row electrodes. It is because it is necessary to apply pulse voltages having different polarities to the row electrodes in order to independently and simultaneously control the display pattern in the column direction. Pulses having polarities are applied by a plurality of times to the row electrodes and voltages in correspondence with data are applied to the column electrodes. In this way, effective voltages in response to ON and OFF are applied to respective pixels in total.

In this case, a group of selection pulse voltages applied to respective row electrodes can be expressed by a matrix of L rows and K columns (hereinafter, referred to as a selection matrix (A)). The selection pulse voltage series can be represented as mutually orthogonal vector groups and therefore, the matrix including these as column elements is an orthogonal matrix. Respective row vectors in the matrix are mutually orthogonal. The number of rows L corresponds to the number of simultaneously selected rows and each row corresponds to each line. For example, the element of the first line of the selection matrix (A) is applicable to line 1 among L selection lines. Further, voltages as selection pulses are applied in the order of the element of the first column, the element of the second column and so on.

With respect to the description of the selection matrix (A) in this specification, numeral 1 designates a positive selection pulse and numeral −1 designates a negative selection pulse. FIGS. 4(*a*), 4(*b*) and 4(*c*) show Hadamard's matrices as representative examples of the selection matrix (A). FIG. 4(*a*) shows that of 4 rows and 4 columns, FIG. 4(*b*) shows that of 8 rows and 8 columns and FIG. 4(*c*) shows that of 7 rows and 8 columns which is formed by removing the first column of that of 8 rows and 8 columns.

Voltage levels in correspondence with respective column elements of the matrices and a display pattern on the column electrodes are applied to the column electrodes. Namely, the column electrode voltage series are determined by the matrices determining the row electrode voltage series and the display pattern.

A sequence of voltage waveforms applied to the column electrodes is determined as follows. FIGS. 3(*a*), 3(*b*) and 3(*c*) are diagrams showing the concept. Explanation will be given with Hadamard's matrix of 4 rows and 4 columns as an example. The display data on a column electrode i and a column electrode j are as shown in FIG. 3(*a*). Column display patterns are designated by vectors (d) as shown in FIG. 3(*b*). Here, −1 of a column elements designates ON display and 1 thereof designates OFF display. When the row electrode voltages are successively applied to the row electrodes in the order of the columns of the matrix, the column electrode voltage levels become vectors (v) as shown in FIG. 3(*b*) and the waveforms are as shown in FIG. 3(*c*). In FIG. 3(*c*), arbitrary units are used for an ordinate axis and an abscissa axis.

In a case of partial line selection, it is preferable to apply voltages dispersibly in one display cycle in order to control the frame response of the liquid crystal display element. Specifically, for example, after applying the first element of the vector (v) corresponding to the first simultaneously selected row electrode group (hereinafter, referred to as the subgroup), the first element of the vector (v) corresponding to the second simultaneously selected row electrode group is applied, and the same sequence is carried out successively.

Thus, an actual voltage pulse sequence applied to the column electrodes is determined by how the voltage pulses are dispersed in one display cycle and which selection matrix (A) is selected to the respective simultaneously selected row electrode group.

Recently, a window pattern display has very frequently been used. When the window pattern display is effected, a phenomenon called crosstalk occurs, which is a problem in display.

Influence by the crosstalk is remarkable in displaying a bar-like image. Such phenomenon is described in JP-A-8-62574 and derives from a deformation in the driving waveform.

The other big problem is crosstalk in a display of intermediate tone. For systems of displaying an intermediate tone, there are a frame rate control (FRC) system, an amplitude modulation system, a combination thereof with a dither method and so on. However, the FRC system has widely been employed as the driving method for a liquid crystal display device. In this case, a combination of the FRC system and a technique for forming a phase difference in terms of space (i.e., between adjacent pixels) to cancel a flicker (i.e., a space modulation method) is frequently employed. When such a gray scale display is carried out, there is a case that the spatial frequency of an image becomes very high. The height of the spatial frequency causes the crosstalk to deteriorate the quality of the image. Similarly, when the dither system is employed, the spatial frequency is also increased. Thus, there existed the problem of crosstalk. Further, there is a problem of deterioration of image in a case that a dynamic image in a video display is to be displayed. In the video display, a spatially complicated display (i.e. a high spatial frequency) is often displayed unlike a basically geometrical display such as a window display. Accordingly, in a case of providing a video display in one window, there arose such problems that not only the quality of the video display itself was deteriorated by the crosstalk produced but also adverse influence was given to a peripheral window. In order to reduce the above-mentioned crosstalk, it is effective to lower the main component of frequency of a driving waveform into a more flat frequency region in the frequency characteristics of the liquid crystal display device, specifically, it is effective to introduce polarity inversion at a timing independent of the display frame. However, in the multiple line simultaneous selection method, the addressing method is fundamentally different from that in the conventional line-sequential driving method and accordingly, the introduction of the polarity inversion caused another special drawback of display whereby there was a big problem in achieving the reduction of the crosstalk and an improvement of the quality of display.

Further, in the multiple line simultaneous selection method, the plurality of data voltage levels are provided as described above and an actual waveform is determined by the display data and the orthogonal matrix used. Accordingly, there causes frequent transition in voltage levels, and this strongly influences the occurrence of the crosstalk. The formation of a waveform by the plurality of data voltage levels creates difficulty in controlling the crosstalk in the multiple line simultaneous selection method.

The present invention is to provide a driving method to overcome problems of the crosstalk and the quality of display in the multiple line simultaneous selection method.

SUMMARY OF THE INVENTION

In order to eliminate the above-mentioned problems, there is provided a method of driving a picture display device having an N number (N is an integer of not less than 2) of scanning electrodes and a plurality of data electrodes and being capable of optically responding to an effective value of a voltage applied to a pixel, which comprises dividing the scanning electrodes into an M number of subgroups each comprising L rows, and applying voltages based on signals formed by expanding time-sequentially column vectors of an orthogonal matrix (A) having L rows to the scanning electrodes in each of the subgroups in order to select each of the subgroups together, changing, every time when a selection pulse is applied, the subgroups to which the selection pulse is applied, wherein L is 8 or less and N is 200 or more; the polarities of scanning voltages and data voltages are inverted with a periodicity of S times (S is a natural number) of a selection pulse width, and S is so determined that when an integer portion in the quotient of M/S is an even number, a remainder b satisfies $S/b<12$, and when an integer portion in the quotient of M/S is an odd number, a remainder b satisfies $S/(S-b)<12$.

Further, there is provided a method of driving a picture display device described above wherein S does not include a prime factor of M as a divisor.

Further, in the above-mentioned method of driving a picture display device, the smallest value a which satisfies a relation of $aM/S=p$ and 1 or $S-1$ as a remainder (a and p are respectively an integer) and the smallest value c in $cM/S=q$ (c and q are respectively an integer) satisfy a relation of $c/a \leqq 6$.

Further, there is provided a picture display device having an N number (N is an integer of 200 or more) of scanning electrodes and a plurality of data electrodes and being capable of optically responding to an effective value of a voltage applied to a pixel determined as the intersection of a scanning electrode and a data electrode wherein the scanning electrodes are divided into a plurality of subgroups each comprising L rows (L is an integer of from 2 to 8); voltages based on signals formed by expanding time-sequentially column vectors of an orthogonal matrix having L rows are applied to the scanning electrodes in each of the subgroups in order to select each of the subgroups together; and voltages having at least three kinds of levels which are based on signals obtained by the orthogonal transformation of display data by the orthogonal matrix are applied to the data electrodes, the image display device being characterized in that a power source section for supplying data voltages includes dividing resistors and a voltage stabilizing circuit connected to outputs from the dividing resistors, and the voltage stabilizing circuit is so formed that the current supplying ability of a power source which supplies voltage levels for a high load in a display among data voltage levels is made larger than the current supplying ability of the power source which supplies the other voltage levels.

Further, there i s provided a picture display device as described above wherein the current supplying ability of the power source which supplies data voltage levels selected when a display pattern in the subgroups is entirely ON, entirely OFF or an ON/OFF repetition pattern for each pixel is made larger than the current supplying ability of the power source which supplies the other data voltage levels.

BRIEF DESCRIPTION OF DRAWINGS

FIG. 3(*a*) is a diagram for explaining a voltage applying method in a multiple line simultaneous selection method.

FIG. 3(*b*) is a diagram for explaining a voltage applying method in a multiple line simultaneous selection method.

FIG. 3(*c*) is a waveform for explaining the voltage applying method in the multiple line simultaneous selection method.

FIG. 4(*a*) is a diagram showing a Hadamard's matrix.

FIG. 4(*b*) is a diagram showing a Hadamard's matrix.

FIG. 4(*c*) is a diagram showing a Hadamard's matrix.

FIG. 5 is a diagram showing a selection matrix used in an example.

DESIRED EMBODIMENTS

Figures 1A, 1B:
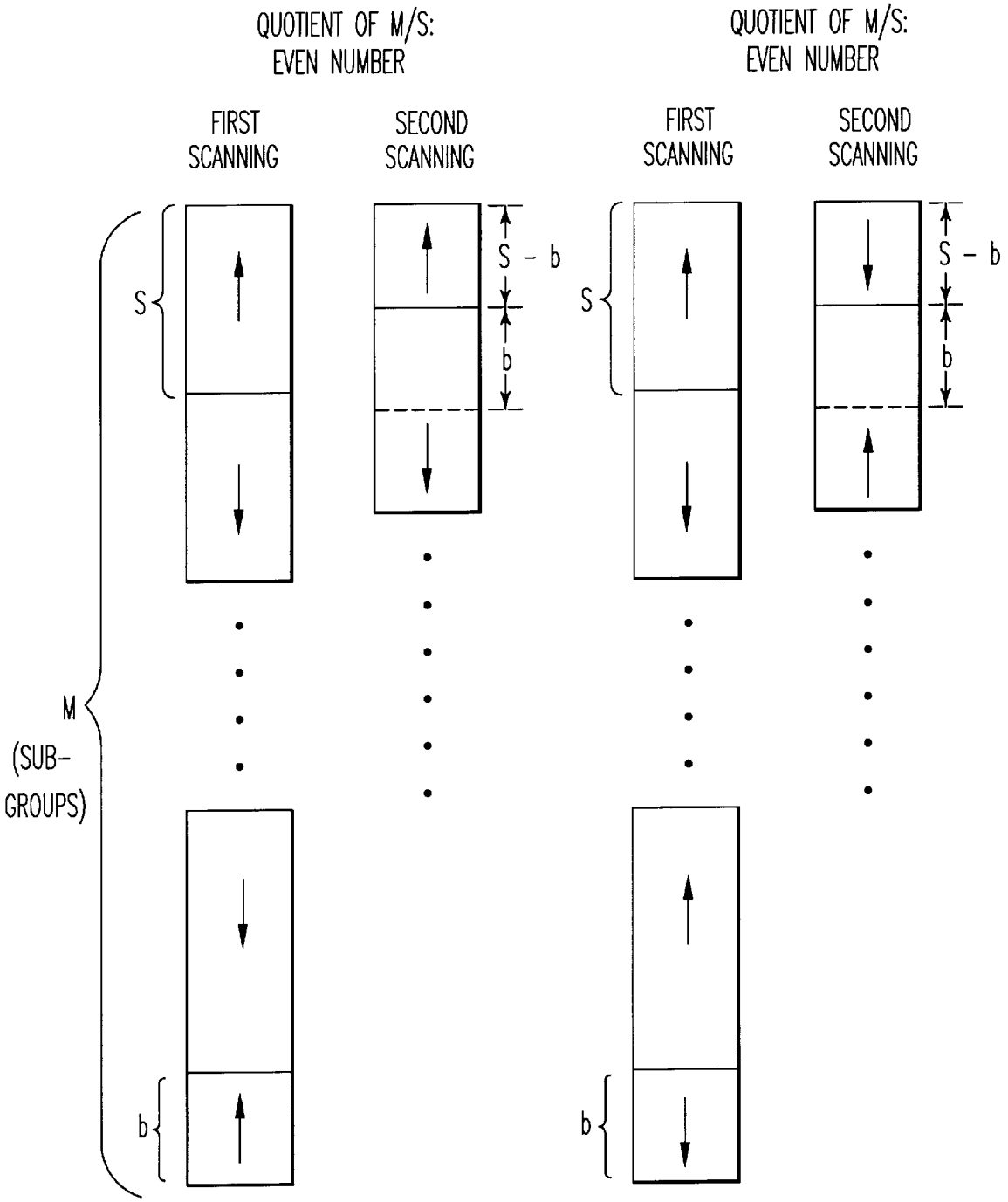
FIG. 1 is a diagram for explaining the method of driving according to the present invention.

According to analysis by the inventors, the defect derived from the above-mentioned polarity inversion is considered as the phenomenon described hereinbelow.

First, description will be made as to addressing techniques of the conventional line-sequential driving method (APT method) and a multiple line simultaneous selection method (a dispersion type multiple line simultaneous selection method wherein selection pulses in respective rows are dispersed in a display frame).

In the APT method, respective selection lines are selected once in one display frame and at that time, display data are supplied from the column electrodes wherein a display is realized. Accordingly, it is necessary to introduce polarity inversion so as to form an alternate current form in once time of selection throughout several frames.

On the other hand, in the multiple line simultaneous selection method, a plurality of lines are simultaneously selected and one display frame is completed by a plural number of selections for each lines. Accordingly, it is necessary to determine a period of polarity inversion so as to form an alternate current form in the plural number of times of selection. Further, since a plurality of lines are simultaneously selected in the multiple line simultaneous selection method and if a time width of selection pulses is the same as that of the APT method, the next selection has to be done at shorter time intervals. In summarizing a large difference in the addressing technique between the multiple line simultaneous selection method and the APT method, the difference is as shown in Table 1.

TABLE 1

| | Multiple line simultaneous selection method | APT method |
|---|---|---|
| Number of times of selection in one frame | Plural times (M times) | once |
| Interval of selection | 1/M frame | 1 frame |

Namely, in the multiple line simultaneous selection method, it is necessary to produce an alternate current form in each of the plural number of times of selection with a shorter period than the APT method.

Defective displays possibly caused by the polarity inversion are generally classified into 1) a lateral stripe phenomenon, 2) beating and 3) a flicker.

1) In the lateral stripe phenomenon, a stripe is observed along the line because of subgroups (row electrode groups simultaneously selected) having different brightness in a case of providing a uniform flat display. This is due to a reduction of row voltages (selection voltages) derived from a deformed waveform on the row electrodes which is produced at the time of the polarity inversion of a column voltage waveform.

2) The beating is a phenomenon observed when a lateral stripe along a direction of line which has a difference of brightness moves in a column direction. The phenomenon includes that which occurs commonly in the APT method (hereinbelow, referred to as a type A for convenience) and that which occurs inherently in the multiple line simultaneous selection method (hereinbelow, referred to as a type B for convenience), both being to be reduced.

The type A is derived from that a spatial position where the polarity inversion takes place, gradually moves with time. In the case of the multiple line simultaneous selection method, it is necessary to consider to select a plurality of lines. Accordingly, as in the case of the APT method, it is insufficient to consider only the spatial position on the polarity inversion for the next election scanning, and the spatial position on the polarity inversion among a plurality of scanning should be considered.

The type B occurs in relation to the plural selection itself and the polarity inversion. It occurs when selection of a positive polarity and selection of a negative polarity are simultaneously performed in the multiple line simultaneous selection. Namely, assuming a case that a differential waveform is on a line by the polarity inversion when a certain subgroup is selected. In this case, in the differential waveform, the contribution to an increase and a decrease of the effective voltage is opposite depending on cases that the selection waveform is positive or negative. For example, when the differential waveform appears in a positive direction, the voltage is increased when there is a positive selection waveform, and the effective voltage is decreased when there is a negative selection waveform. Thus, there exists lines having different effective voltages in the subgroups. No problem takes place when the increase and decrease of the effective voltage are cancelled while a plurality of selections are performed. However, this is a special condition, and a state of deflected polarity wherein either polarity is weighted is generally takes place. The lateral stripe is seen in a flowing state in response to the scanning.

3) There are two kinds of flicker which appear at the time of a binary display and a gray scale display. In any case, there appears a flicker phenomenon wherein a bright portion and a dark portion in an image are presented repeatedly in terms of time due to very low frequency components in waveforms applied to the display element by the polarity inversion and the addressing technique. Generally, it often occurs due to a buzzing phenomenon by frequency components in two or more different waveforms. In particular, when a direct current component is applied, there occurs a flicker in which a frequency of ½ of the basic frequency is produced, and it is very conspicuous. The direct current component is often produced by a power source having an asymmetrical polarities by which a voltage is applied. When there are a plurality of column voltage levels as in the multiple line simultaneous selection method, it is in particular important to optimize the driving technique so as not to cause such disadvantage.

In order to eliminate the problem on the above-mentioned display, the present invention proposes a driving method which satisfies the first condition described below. Namely, when the number of subgroups is M, the polarities of scanning voltages and data voltages are inverted with a periodicity of S times (S is a natural number) of the selection pulse width wherein S is so determined that when an integer portion in the quotient of M/S is an even number, a remainder b satisfies S/b<12, and when an integer portion of the quotient of M/S is an odd number, a remainder b satisfies S/(S−b)<12.

As described above, the flicker results from the low frequency components in the waveform. Depending on the value S of polarity inversion period, a certain subgroup may have a frame in which the selection pulses having the same polarity are concentrated whereby a low frequency component is increased. The first condition is to restrict the number of times in which the same polarity appears continuously whereby the production of a low frequency component is restricted.

FIG. 1 is a diagram showing such a state. FIG. 1(*a*) shows a case that an integer portion of the quotient of M/S is an even number, and FIG. 1(*b*) shows a case that an integer portion of the quotient of M/S is an odd number. It is clear from the figure that in a case of subsequent two scanning, "b/S" indicates a proportion of polarity inverted subgroups when an integer portion of the quotient of M/S is an even number, and "(S−b)/S" indicates a proportion of polarity inverted subgroups when an integer portion of the quotient of M/S is an odd number. Accordingly, the condition for suppressing the flicker is that respective values are greater than predetermined values. It is because occurrence of the polarity inversion can be suppressed for a longer time and the number of subgroups in which low frequency components are produced in driving waveforms is reduced. In this case, it is preferable that S does not have a prime factor of M as a divisor. When S has a prime factor of M as a divisor, the polarity inversion occurs at a specified position whereby the lateral stripe phenomenon may be caused.

Further, the present invention preferably satisfies the second condition described below.

Namely, the smallest value a which satisfies a relation of aM/S=p and 1 or S−1 as a remainder (a and p are respectively an integer) and the smallest value c in cM/S=q (c and q are respectively an integer) satisfy a relation of c/a≦6.

The beating phenomenon takes place when a differential waveform caused by the polarity inversion is applied to row electrodes and a change of brightness occurs due to a difference between the effective voltages wherein the change of brightness is gradually shifted upward or downward with time. As described above, the addressing technique in the multiple line simultaneous selection method is more complicated than that of the conventional driving method. The look of the beating phenomenon varies depending on a time width (an interval) from a polarity inversion to another polarity inversion in a certain subgroup and an amount of shift of a position of the polarity inversion with respect to directions in terms of time and space. As the interval is wider and an inclination of the shift of the position of the polarity inversion is smaller, the beating is easily seen.

The smallest value a in aM/S=p and 1 or S−1 as a remainder represents an inclination in direction of the shift of the polarity inversion, and indicates occurrence of the polarity inversion above (or below) one subgroup after scanning of a has been performed. Further, the smallest value c in cM/S=q indicates a period wherein the next polarity inversion occurs in the same subgroup. Namely, the value of c/a indicates a period of beating. As this value is larger, a low frequency component is increased whereby the beating is apt to be seen. The inventors of this application have found that the beating can be suppressed by satisfying the relation of c/a≦6.

In the present invention, when the first and second conditions are applied, the number of simultaneous selected lines L should be 8 or less and the number of all lines N should be 200 or more. When L exceeds 8, the column waveform becomes complicated and it is very difficult in practical use to control the quality of display. Further, when L is 200 or less, the duty ratio is low and the voltage margin is large. Accordingly, the problem of beating as described above is difficult to occur.

The present invention is to reduce the defective display caused by the polarity inversion as described above and to provide a picture of high quality. Further, since a crosstalk can be reduced, a picture of high quality such as a dynamic image, a display on a personal computer can be provided.

Further, in the present invention, driving at a bias ratio different from that in the conventional technique can be employed based on an unique waveform used in the multiple line simultaneous selection method. Here, the bias ratio is defined by the maximum value of the row voltage/the column voltage. A bias ratio which provides the highest contrast ratio (an optimized bias ratio) is $N^{1/2}/L$. In the APT method, the column voltages become excessively high. Accordingly, the bias ratio generally used is smaller than the optimized bias ratio.

However, in the multiple line simultaneous selection method, it is unnecessary to use a bias ratio smaller than the optimized bias ratio, as in the APT method, from two reasons as follows:

1) In the APT method, the bias ratio should be small to obtain a high contrast ratio because of the frame response. However, in the multiple line simultaneous selection method, the frame response can be controlled by the system itself, and
2) the row voltages in the multiple line simultaneous selection method are lower than that in the APT method.

Rather, it is desirable that such voltage ratio be higher than the optimized bias ratio. The reason is that use of such bias ratio reduces a contribution of the column voltages and a crosstalk due to variations of the column voltages is reduced whereby it is possible to reduce the crosstalk without the reduction of the contrast ratio.

Specifically, a more preferable condition to obtain a picture of high quality in the picture display device of the present invention is to satisfy the relation of the following formula 1:

$$N^{1/2}/L \leqq Vr/Vc,max \leqq 1.4N^{1/2}/L \qquad \text{Formula 1}$$

where Vr represents a voltage amplitude of the scanning voltages and Vc,max represents the maximum voltage amplitude of the column voltage.

A further preferable embodiment of the present invention will be described.

Important points in attempt to reduce the crosstalk is that the crosstalk depends on a driving waveform, a load (such as the capacitance of liquid crystal, the resistance of electrodes and so on) to the power source and the ability of the power source supplying a current to the liquid crystal wherein these factors are interactive.

In this embodiment, a structure formed by optimizing the driving waveform and the power source system in the multiple line simultaneous selection method is presented whereby a picture of high quality is provided in the picture display device in which the multiple line simultaneous selection method is employed.

In this embodiment, the following conditions are characteristic features.

(1) The number of simultaneous selection in the multiplex line simultaneous selection method is from 2 to 8.

(2) The current supplying ability of a power source which supplies voltage levels for a high load element for a display among several data voltage levels is increased. Namely, the ability of the power source which supplies various data voltage levels is changed depending on a frequency of use of the data voltage levels.

The first condition is so determined that the number of the data voltage levels and the maximum value of the data voltages are not excessively large. When the number of simultaneously selected lines L is increased, the number of the data voltage levels is generally increased to (L+1) and the maximum voltage is increased in proportion to $L^{1/2}$. Accordingly, when L becomes excessively large, the waveform becomes complicated and the voltage amplitude becomes large whereby the crosstalk is increased. Thus, the first condition is provided.

More detailed explanation will be made. In the multiple line simultaneous selection method, selection pulses, which in the conventional method, were one per line in a display frame, are applied to the scanning electrodes by dividing them in a plural number of times, and data voltages are determined so as to correspond to the divided selection pulses. Accordingly, the selection and the voltage balance of data vary in response to the number of simultaneously selected lines and a state of occurrence of the crosstalk varies.

For easy understanding, explanation will be made as to a case that in the selection voltage and the data voltage, a voltage ratio of an ON waveform to an OFF waveform is theoretically the optimized bias ratio. When the data voltage in the APT method as the conventional line-sequential driving method is 1, the maximum values of the selection voltages Vr and the data voltages Vc in the multiple line simultaneous selection method are respectively $Vr=N^{1/2}/L^{1/2}$ and $Vc=L^{1/2}$ with respect to an L number of simultaneous selection lines wherein N represents the number of all lines.

As is clear from the formulas, with an increase of L, the selection voltages Vr decrease and the data voltages Vc increase. Accordingly, a change of L causes a change in the intensity of the crosstalk. Further, a degree of the change varies depending on a kind of the crosstalk. As described above, the range of L is strongly related to the intensity of the crosstalk.

The second condition is provided on the basis of the finding by the inventors that for respective data voltage levels, there are different loads to the power source and there are generally levels to a large load and levels to a small load. Namely, when driving is conducted by the multiple line simultaneous selection method, data voltages in proportion to the inner product of the vectors of display data patterns and column vectors of the selection matrix are applied. Many of display patterns of $2^L$ kinds are generally regular patterns such as a continually ON pattern, a continually OFF pattern, an ON/OFF alternate pattern, a dual ON/dual OFF alternate pattern and so on. Accordingly, the data voltages are apt to have limited values and loads are apt to concentrate to certain voltage levels. By enhancing the ability of the power source to such voltage levels in comparison with other voltage levels, it is possible to reduce the deformation of the waveform due to the imbalance of loads whereby a display minimizing the crosstalk is provided.

For example, when L=4 and the selection matrix as shown in FIG. 5 is used, (d) and (v) according to FIG. 3 become as follows.

A case of a continual ON display:

(d) (−1, −1, −1, −1) and (v) (−2, −2, −2, −2)

A case of continual OFF display:

(d) (1, 1, 1, 1) and (v) (2, 2, 2, 2)

A case of an ON/OFF alternate display:

(d) (−1, 1, −1, 1) and (v) (2, −2, 2, −2)

A case of dual ON/dual OFF alternate display:

(d) (−1, −1, 1, 1) and (v) (2, 2, −2, −2)

In the above-mentioned four kinds of display, only voltage levels corresponding to 2 or −2 are required and the other voltage levels are unnecessary.

Figure 2:
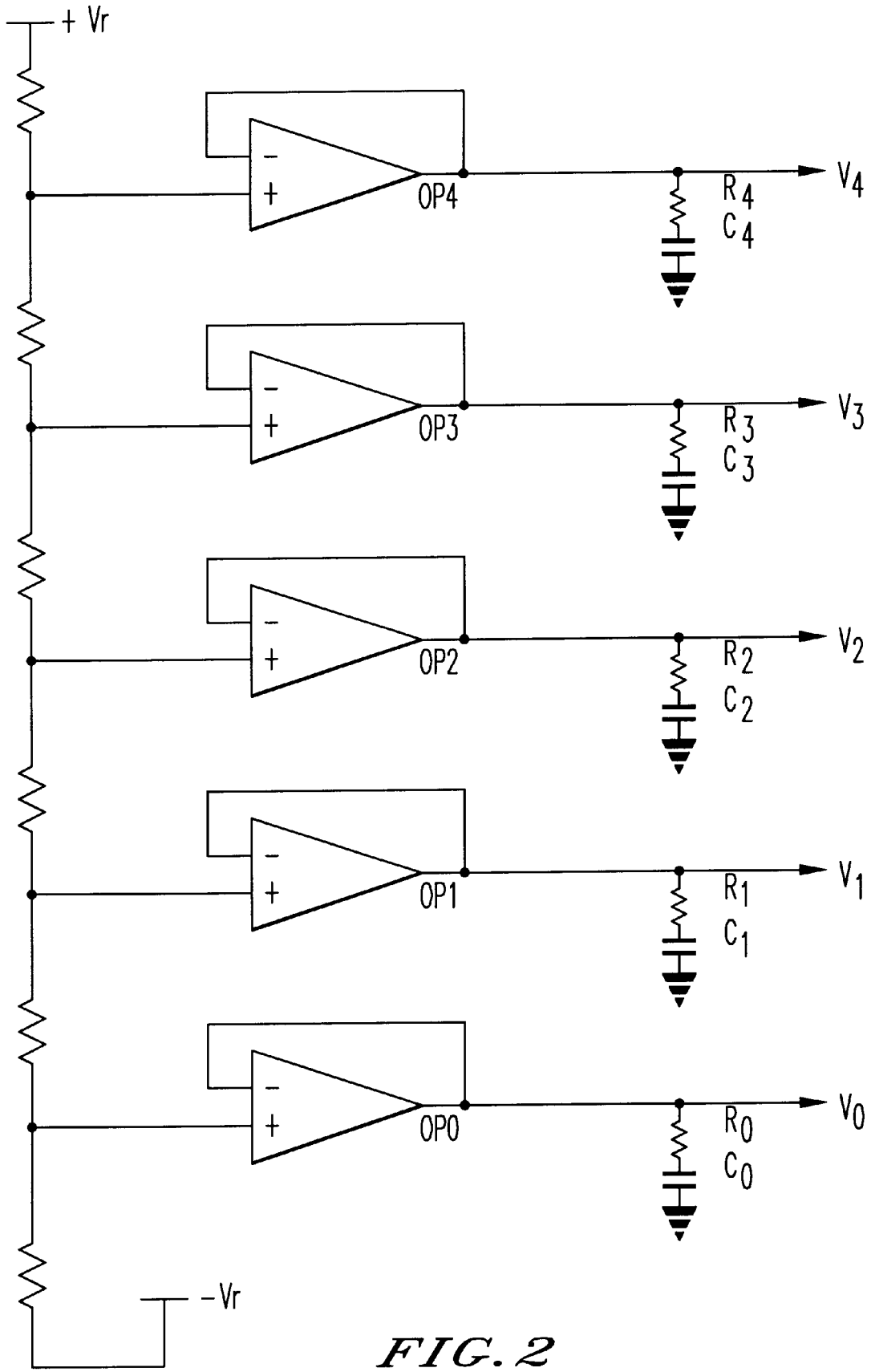
FIG. 2 is a structural diagram of a data voltage supplying power source used for the present invention.

As a power source circuit, such one as shown in FIG. 2 is generally used. Namely, respective voltage levels produced by dividing resistors are outputted as $V_0$–$V_4$ through operation amplifiers. Capacitors are interposed between lines for applying voltages and the earth in order to form smoothed voltages. The operation amplifiers and the capacitors form a voltage stabilizing circuit. In the drawing, OP0–OP4 designate operation amplifiers to produce outputs of low impedance; $C_0$–$C_4$ designate the capacitances of smoothing capacitors, and $R_0$–$R_4$ designate equivalent series resistances inside the smoothing capacitors.

The elements of (v) and the voltage levels respectively correspond to $-4=V_0$, $-2=V_1$, $0=V_2$, $2=V_3$ and $4=V_4$. Namely, in the above-mentioned patterns which are often used, loads concentrate to $V_1$ and $V_3$. As a result, the deformation of the waveform from the power source is reduced by increasing the current supplying ability of the power source to $V_1$ and $V_3$ in comparison with $V_0$, $V_2$ and $V_4$ whereby an excellent display free from the crosstalk is provided.

Methods for realizing this as follows.

(1) The current supplying ability of the operation amplifiers in connection with $V_1$ and $V_3$ is respectively increased in comparison with $V_0$, $V_2$ and $V_4$ whereby a recovering rate of voltage drop due to variation of load is increased to reduce the deformation of waveform.

(2) The capacitance of the smoothing capacitors for $V_1$ and $V_3$ is respectively increased in comparison with $V_0$, $V_2$ and $V_4$. With an increase of the capacitance, a voltage drop due to the variation of load is reduced to reduce the deformation of waveform.

(3) The equivalent series resistance of the smoothing capacitors for $V_1$ and $V_3$ is respectively decreased in comparison with $V_0$, $V_2$ and $V_4$. The equivalent series resistance functions to limit an amount of electric current from the capacitors when an instantaneous change of load takes place. As the value of the resistance is smaller, the ability of supplying an instantaneous current is large with the result that the deformation of waveform is reduced.

Thus, by the determination that a current supplying ability of the power source which supplies voltage levels for a higher load in a display among data voltage levels is made larger than a current supplying ability of the power source which supplies the other voltage levels, the deformation of waveforms generated from the power source between a large load and a small load is balanced to reduce the crosstalk. It is very difficult to remove completely the deformation of waveforms. A remarkable balancing effect can be obtained by changing the current supplying ability depending on voltage levels as in the present invention rather than a case that the current supplying ability is uniformly enhanced for each of the voltage levels.

When the number of simultaneously selected row electrodes is an even number, $V_2$ and the low electrode selection voltages are at an equal potential. Accordingly, the power source for the both voltages may be used commonly. In this case, it is preferable to increase the current supplying ability of the power source for $V_2$ in order to suppress the deformation of waveform on the row electrodes.

The present invention can be realized by using the conventionally known circuit for multiple line simultaneous selection. For example, when a FRC system is used for providing a gray scale display, a comparator with a look-up table of spatial modulation FRC is put in the previous stage wherein multi-bit data of the initial stage are stored in the memories; input data subjected to a FRC treatment are compared with a threshold value taken out from the look-up table to determine ON or OFF, one-bit (1 frame) data after the determination of ON or OFF are stored in the memories, then, the stored data are successively read for multiple line simultaneous selection operations whereby column electrode voltage waveforms can be calculated. Further, the multi-bit data are stored in the memories and 1-bit FRC data are produced by reference to the spatial modulation FRC table at the previous stage of column voltage calculation.

Although the spatial modulation table may be stored in ROM and successively read out to use it, it is easy to form it by logic circuits. The column voltage waveforms calculated by these circuits are inputted into column signal drivers having a plurality of voltage levels and voltages are applied to the liquid crystal to provide a display.

Now, the present invention will be described in further detail with reference to Examples. However, it should be understood that the present invention is by no means restricted to such specific Examples.

EXAMPLES 1 TO 4 AND COMPARATIVE EXAMPLE

The detail of the liquid crystal panel used is as follows. Namely, the response time (the average between a rising time and a falling time) is less than 100 ms and the twist angle of liquid crystal is 220–260°.

Example 1

A color STN display element of VGA (640×480×3 (RGB)) was divided into two (upper and lower) picture surfaces for driving. The number of lines in a picture surface was 240. A multiple line simultaneous selection driving was conducted with a simultaneous selection number L=4 (i.e., the number of subgroups=61 wherein one of the subgroups was a dummy subgroup used for obtaining good selection pulse sequence). The size of the display picture surface was of a diagonal line of 10.4 inches, the transparent electrode used was ITO and the sheet resistance was 5 Ω.

The orthogonal matrix used was as shown in FIG. 5. For the gray scale display, a FRC system was used.

The maximum driving voltage (Vr) was about 16 V. The bias ratio was the optimized bias ratio (3.9). The period for polarity inversion was 25 times as much as the selection pulse width.

The above conditions were in correspondence to M=61, S=25, b=11, a=9 and c=25, which satisfy the above-mentioned the first and second conditions.

In conducting a video display, a fine gray scale display substantially free from a flicker, beating and a crosstalk could be obtained. The frame frequency for driving was 120 Hz; the contrast ratio was 50:1, and the response time (the average between a rising time and a falling time) was 50 ms.

Example 2

A color STN display element of SVGA (800×600×3 (RGB)) was divided into two (upper and lower) picture surfaces for driving. The number of lines in one picture surface was 300. The multiple line simultaneous selection driving was conducted with a simultaneous selection number L=4 (i.e., the number of subgroups=77 wherein two of the subgroups were dummy subgroups used for obtaining good selection pulse sequence). The size of a display picture surface was of a diagonal line of 12.1 inches. The transparent electrode used was ITO and the sheet resistance was 4 Ω.

The orthogonal matrix used was as shown in FIG. 4. For the gray scale display, a FRC system was used to effect a display of 16 gradations.

The maximum driving voltage (Vr) was about 18 V. The bias ratio was 1.2 times (=5.2) as much as the optimized bias. The period for polarity inversion was 12 times as much as the selection pulse width.

These conditions were in correspondence to M=77, S=12, b=5, a=5 and c=12 which satisfy the above-mentioned first and second conditions.

In conducting a video display, a fine gray scale display substantially free from a flicker, beating and a crosstalk was obtained. The frame frequency for driving was 120 Hz; the contrast ratio was 50:1 and the response time (the average between a rising time and a falling time) was 65 ms.

In the following, an example which employs a preferred embodiment of the present invention will be described. The liquid crystal panel used was a STN display panel having a cell gap of 4–6 μm and a twist angle of 220–260°.

Example 3

A color STN display element of VGA (640×480×3 (RGB)) was divided into two (upper and lower) picture surfaces for driving. The number of lines in one picture surface was 240. The multiple line simultaneous selection driving was conducted with a simultaneous selection number L=4 (i.e., the number of subgroups=60). The size of the display picture surface was of a diagonal line of 10.4 inches; the transparent electrode used was ITO and the sheet resistance was 5 Ω. The orthogonal matrix used was as shown in FIG. 5. For the gray scale display, a FRC system was used.

The maximum driving voltage (Vr) was about 16 V. The bias ratio was the optimized bias ratio (3.9). The levels of column voltage were 5 in total ($V_0$, $V_1$, $V_2$, $V_3$ and $V_4$ in the order of lower values). The capacitance of the capacitors for $V_1$ and $V_3$ levels was 10 μF and the capacitance of the capacitors for $V_0$, $V_2$ and $V_4$ was 4.7 μF. The current supplying ability of the operation amplifiers was 30 mA for V, and $V_3$ levels, and was 20 mA for $V_0$, $V_2$ and $V_4$ levels respectively. For $V_2$ and the row voltages, the power source was separated.

In effecting a video display, a fine gray scale display substantially free from a flicker, and a crosstalk could be obtained. The frame frequency for driving was 120 Hz; the contrast ratio was 50:1 and the response time (the average between a rising time and a falling time) was 50 ms.

Example 4

A color STN display element of SVGA (800×600×3 (RGB)) was divided into two (upper and lower) picture surfaces for driving. The number of lines in one picture surface was 300. The multiple line simultaneous selection driving was conducted with a simultaneous selection number L=4 (i.e., the number of subgroups=75). The size of the display picture surface was of a diagonal line of 12.1 inches. The transparent electrode used was ITO and the sheet resistance was 4 Ω. The Orthogonal matrix used was as shown in FIG. 5. For the gray scale display, a FRC system was used.

The maximum driving voltage (Vr) was about 18 V. The bias ratio was 1.2 times as much as the optimized bias ratio.

The levels of column voltage was 5 in total. The capacitance of the capacitors for $V_1$ and $V_3$ levels was 20 μF: the equivalent series resistance value was 1.2 Ω; the capacitance of the capacitors for $V_0$, $V_2$ and $V_4$ levels was 10 μF and the equivalent series resistance value was 5 Ω. For $V_2$ and the row voltages, the power source was separated.

In conducting a video display, a fine gray scale display substantially free from a flicker, a crosstalk could be obtained. The frame frequency for driving was 120 Hz; the contrast ratio was 50:1 and the response time (the average between a rising time and a falling time) was 65 ms.

Comparative Example

A liquid crystal display device was made for display in the same manner as Example 4 except that for the levels of column voltage, the capacitance of the capacitors for $V_0$, $V_2$ and $V_4$ was 20 μF, the current supplying ability of the operation amplifiers was 40 mA: the capacitance of the capacitors for $V_1$ and $V_3$ was 10 μF and the current supplying ability of the operation amplifiers was 20 mA.

In conducting a video display, a fine gray scale display substantially free from a flicker could be obtained, however, the level of a crosstalk was inferior to that in Example 4. The frame frequency for driving was 120 Hz; the contrast ratio was 30:1 and the response time (the average between a rising time and a falling time) was 150 ms. In the video display, an intense residual image was found.

The present invention makes it possible to provide a display of quick response and high contrast ratio while minimizing a flicker, beating and a crosstalk by extracting fully the characteristic of the multiple line simultaneous selection method and a liquid crystal display element of quick response, and allows a multi-gradation display of dynamic image by a passive matrix which has not conventionally been obtained. Further, the present invention can reduce the power source voltage in comparison with the conventional driving method.

What is claimed is:

1. A method of driving a picture display device having an N number (N is an integer of not less than 2) of scanning electrodes and a plurality of data electrodes and being capable of optically responding to an effective value of a voltage applied to a pixel, which comprises:

dividing the scanning electrodes into an M number of subgroups each comprising L rows; and applying voltages based on signals formed by expanding time-sequentially column vectors of an orthogonal matrix (A) having L rows to the scanning electrode in each of the subgroups in order to select each of the subgroups together;

changing, every time when a selection pulse is applied, the subgroups to which the selection pulse is applied, wherein L is 8 or less and N is 200 or more;

the polarities of scanning voltages and data voltages are inverted with a periodicity of S times (S is a natural number) of a selection pulse width; and S is so determined that when an integer portion in the quotient of M/S is an even number, a remainder b satisfies S/b<12, and when an integer portion in the quotient of M/S is an odd number, a remainder b satisfies S/(S−b)<12.

2. A method of driving a picture display device according to claim 1, wherein S does not include a prime factor of M as a divisor.

3. A method of driving a picture display device according to claim 1, wherein the smallest value a which satisfies a relation of aM/S=p and 1 or S−1 as a remainder (a and p are respectively integers) and the smallest value c in cM/S=q (c and q are respectively an integer) satisfy a relation of c/a≦6.

4. A method of driving a picture display device according to claim 1, wherein a voltage amplitude Vr of the scanning voltages and the maximum voltage amplitude Vc max of the data voltages satisfy the following formula 1:

$$N^{1/2}/L \leqq Vr/Vc,max \leqq 1.4N^{1/2}/L. \quad \text{Formula 1}$$

5. A method of driving a picture display device according to claim 1, wherein in supplying data voltage levels, a current supplying ability of power source which supplies partly voltage levels for a high load in a display is made larger than a current supplying ability of a power source which supplies voltage levels for a load other than said high load.

6. A picture display device having an N number (N is an integer of 200 or more) of scanning electrodes and a plurality of data electrodes and being capable of optically responding to an effective value of a voltage applied to a pixel determined as the intersection of a scanning electrode and a data electrode wherein the scanning electrodes are divided into a plurality of subgroups each comprising L rows (L is an integer ranging from 2 to 8); voltages based on signals formed by expanding time-sequentially column vectors of an orthogonal matrix having L rows are applied to the scanning electrodes in each of the subgroups in order to select each of the subgroups together; and voltages having at least three kinds of levels which are based on signals obtained by an orthogonal transformation of display data by an orthogonal matrix are applied to the data electrodes, the picture display device being characterized in that:

a power source section for supplying data voltages includes dividing resistors and a voltage stabilizing circuit connected to outputs from the dividing resistors, and the voltage stabilizing circuit is so formed that the current supplying ability of a power source which supplies voltage levels for a high load in a display among data voltage levels is made larger than the current supplying ability of a power source which supplies the voltage levels for a load other than said high load.

7. A picture display device according to claim 6, wherein the current supplying ability of the power source which supplies data voltage levels selected when a display pattern in the subgroups is entirely ON, entirely OFF or an ON/OFF repetition pattern for each pixel is made larger than the current supplying ability of the power source which supplies the voltage levels for the load other than the high load.

8. A picture display device according to claim 6, wherein the voltage stabilizing circuit includes capacitors interposed between a voltage supplying line and a grounding line to smooth the data voltages, and the capacitance of the capacitors is increased to increase the current supplying ability of the power source supplying voltage levels for the load other than the high load.

9. A picture display device according to claim 6, wherein the voltage stabilizing circuit includes capacitors interposed between a voltage supplying line and a grounding line to smooth the data voltages, and an equivalent series resistance value of the capacitors is reduced to increase the current supplying ability of the power source supplying voltage levels for the load other than the high load.

10. A picture display device according to claim 6, wherein a voltage amplitude Vr of the scanning voltages and the maximum voltage amplitude of the data voltages Vc,max satisfy the following formula 1:

$$N^{1/2}/L \leqq Vr/Vc,max \leqq 1.4N^{1/2}/L. \quad \text{Formula 1}$$

* * * * *